US009493266B1

(12) United States Patent
Jankowski et al.

(10) Patent No.: US 9,493,266 B1
(45) Date of Patent: Nov. 15, 2016

(54) MOLDED PLASTIC CONTAINER

(75) Inventors: Darrin Ross Jankowski, Union, MO (US); Edward J. Huels, Jr., Union, MO (US); Joshua J. Haen, Maple Grove, MN (US); David J. Lewis, Ramsbury (GB)

(73) Assignee: Silgan Plastic Food Containers Corporation, Union, MO (US)

( * ) Notice: Subject to any disclaimer, the term of this patent is extended or adjusted under 35 U.S.C. 154(b) by 1144 days.

(21) Appl. No.: 12/392,515

(22) Filed: Feb. 25, 2009

(51) Int. Cl.

| | |
|---|---|
| ***B65D 1/02*** | (2006.01) |
| ***B65D 1/16*** | (2006.01) |
| ***B65D 1/46*** | (2006.01) |
| ***B65D 51/20*** | (2006.01) |
| ***B65D 17/00*** | (2006.01) |
| ***B65D 53/00*** | (2006.01) |
| ***B65D 51/18*** | (2006.01) |
| ***B65D 6/00*** | (2006.01) |
| ***B65D 8/04*** | (2006.01) |
| ***B65D 8/18*** | (2006.01) |
| ***B65D 90/02*** | (2006.01) |

(52) U.S. Cl.
CPC ..... *B65D 1/02* (2013.01); *B65D 51/20* (2013.01)

(58) Field of Classification Search
CPC ..... B65D 1/02; B65D 1/16; B65D 1/46; B65D 51/20; B65D 17/161
USPC ..... 215/349, 350; 220/254.8, 258.1, 258.3, 220/258.5, 675
See application file for complete search history.

(56) References Cited

U.S. PATENT DOCUMENTS

| | | | | |
|---|---|---|---|---|
| 3,412,889 | A * | 11/1968 | Eicholtz et al. | 220/788 |
| 4,244,915 | A | 1/1981 | Boardman | |
| 4,346,833 | A * | 8/1982 | Bernhardt | 220/257.1 |
| 4,420,300 | A | 12/1983 | Winstead | |
| 4,817,807 | A * | 4/1989 | Hummer | 215/253 |
| 4,942,974 | A * | 7/1990 | Larrison | B65D 43/021 220/214 |
| 5,459,960 | A | 10/1995 | Manlove | |
| 5,783,229 | A | 7/1998 | Manlove | |

(Continued)

FOREIGN PATENT DOCUMENTS

WO WO 02/085713 10/2002

OTHER PUBLICATIONS

European Patent Office; International Search Report and Written Opinion of the International Searching Authority; Search Report and Written Opinion for PCT/US2010/023909; Aug. 31, 2010; European Patent Office; the Netherlands.

*Primary Examiner* — Fenn Mathew
*Assistant Examiner* — Andrew T Kirsch
(74) *Attorney, Agent, or Firm* — Middleton Reutlinger; John F. Salazar; Chad D. Bruggeman

(57) ABSTRACT

A molded plastic container includes a bottom wall to define a closed end of the container, a side wall extending generally axially away from the bottom wall, and a neck finish terminating the side wall to define an open end of the container. The neck finish includes a finish wall having an inner and outer surfaces. Also, the neck finish may include a seamless external thread segment projecting from the outer surface of the finish wall, and/or a flange extending radially outwardly from the finish wall and also extending axially downwardly and having a section thickness less than that of the finish wall, and/or a bead extending radially inwardly from the inner surface of the finish wall wherein the thickest (Continued)

section of any of the walls of the container extends through the bead.

5 Claims, 8 Drawing Sheets

(56) References Cited

U.S. PATENT DOCUMENTS

| | | | | |
|---|---|---|---|---|
| 6,086,800 | A | 7/2000 | Manlove | |
| 6,145,688 | A * | 11/2000 | Smith | 220/259.3 |
| 6,394,783 | B1 | 5/2002 | Dalgewicz, III et al. | |
| 6,422,414 | B1 * | 7/2002 | Nakamura et al. | 220/669 |
| 6,883,689 | B2 * | 4/2005 | Odet | 222/541.9 |
| 7,014,060 | B2 * | 3/2006 | Richardson | B65D 51/145 220/288 |
| 7,311,218 | B2 * | 12/2007 | Varadarajan | 220/257.1 |
| 2002/0125259 | A1 | 9/2002 | Nakamura et al. | |

* cited by examiner

MOLDED PLASTIC CONTAINER

The present disclosure is directed to molded plastic containers and manufacture of such containers.

BACKGROUND AND SUMMARY OF THE DISCLOSURE

Rotary thermoforming (RTF) may be used to produce plastic containers and typically involves an RTF mold wheel that rotates around a horizontal axis. A plurality of molds around the periphery of the wheel include mold cavities that are aligned along radial axes perpendicular to the axis of rotation of the wheel. A warm and thin thermoplastic sheet is moved into contact with the exterior surface of the wheel and vacuum is applied to pull a portion of the thin sheet into conformity with one of the mold cavities. A mold assist tool may be moved into the mold cavity to finish form the sheet portion into an article. Cam devices may be used to drive mold tooling between a molding position to accept the thermoplastic sheet and an ejection position to eject the molded article. In general, such processes have been well known to those of ordinary skill in the art for decades.

In contrast to RTF processes, injection and blow molding processes are routinely used to produce threaded containers. But according to conventional wisdom in avoiding mold lock conditions and concomitant damage to a threaded container, the threaded container must be unscrewed from its mold in a cumbersome process, or segmented molds must be used but result in undesirable mold seams, parting lines, or flash on the threads.

General objects of the present disclosure may include providing a container that has at least one seamless external thread segment, has an enhanced sealing end surface, and/or that may be removed from a mold without having to unscrew the container from the mold or without having to use segmented molds and without concomitant mold seams on the thread segment(s).

The present disclosure embodies a number of aspects that can be implemented separately from or in combination with each other.

A molded plastic container in accordance with one aspect of the disclosure includes a bottom wall to define a closed end of the container, a side wall extending generally axially away from the bottom wall, and a neck finish terminating the side wall to define an open end of the container. The neck finish includes a finish wall having inner and outer surfaces, and at least one seamless external thread segment projecting from the outer surface of the finish wall.

A molded plastic container in accordance with another aspect of the disclosure includes a bottom wall to define a closed end of the container, a side wall extending generally axially away from the bottom wall, and a neck finish terminating the side wall to define an open end of the container. The neck finish includes a finish wall having inner and outer surfaces, and a bead extending radially inwardly from the inner surface of the finish wall, wherein the thickest section of any of the walls of the container extends through the bead.

A molded plastic container in accordance with a further aspect of the disclosure includes a bottom wall to define a closed end of the container, a side wall extending generally axially away from the bottom wall, and a neck finish terminating the side wall to define an open end of the container. The neck finish includes a finish wall having inner and outer surfaces, and a flange extending radially outwardly from the finish wall and also extending axially downwardly, the flange having a section thickness less than that of the finish wall.

BRIEF DESCRIPTION OF THE DRAWINGS

The disclosure, together with additional objects, features, advantages and aspects thereof, will be best understood from the following description, the appended claims and the accompanying drawings, in which:

DETAILED DESCRIPTION OF PREFERRED EMBODIMENTS

Figure 1:
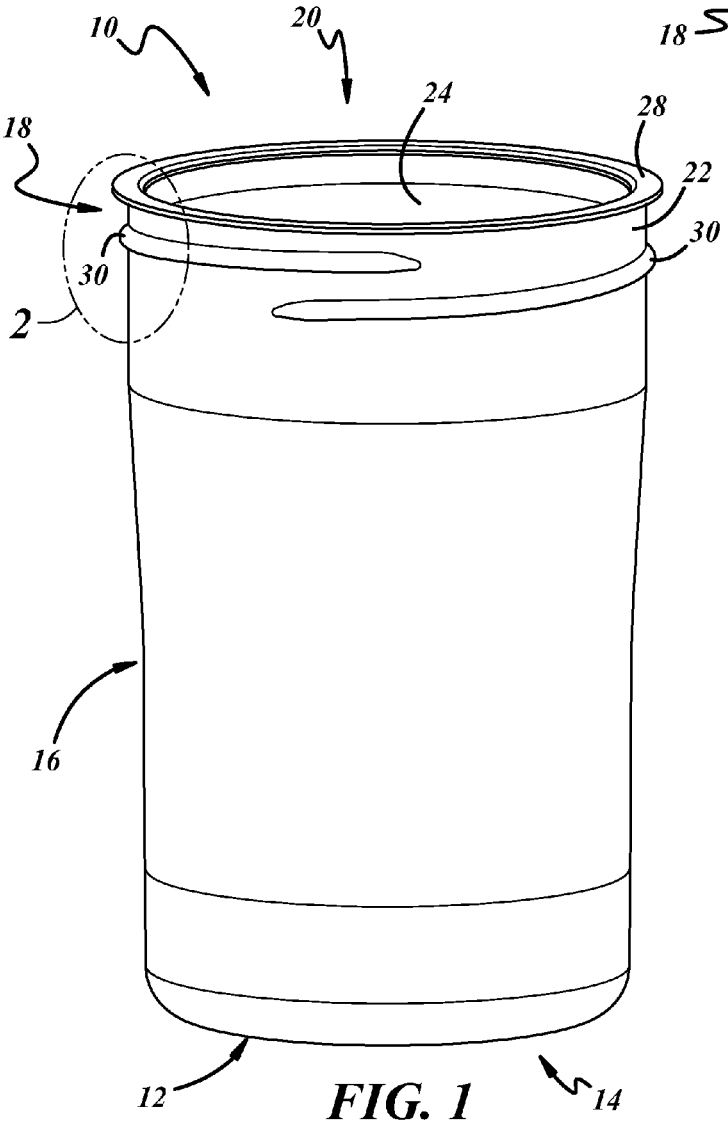
FIG. 1 is a perspective view of a container in accordance with an exemplary embodiment of the present disclosure.

FIG. 1 illustrates a first aspect of the disclosure in the form of an exemplary container 10 molded from any suitable polymer. For example, the polymeric container 10 may be composed of any thermoplastic suitable for RTF processes. In some specific examples, the container 10 may be composed of any material suitable for container retort processes, for refrigerated containers, or the like. In some more specific examples, the container 10 may be composed of polypropylene (PP), PP blended with polyolefin, polyethylene, ethylene vinyl alcohol, and/or the like. In another example, the container 10 may be composed of multiple layers, which may include structural, barrier, and/or adhesive layers.

The molded plastic container 10 includes a bottom wall 12 to define a closed end 14 of the container 10, and a side wall 16 extending generally axially away from the bottom wall 12. The side wall 16 may be necked or incurvately shaped, for example, as shown in FIG. 1. The side wall 16 may be smaller in diameter toward the bottom wall 12 to allow for clearance with a mold during ejection of the container 10. The container 10 also includes a neck finish 18 terminating the side wall 16 to define an open end 20 of the container 10. (As used herein, directional words such as top, bottom, upper, lower, radial, circumferential, lateral, longitudinal, transverse, vertical, horizontal, and the like are employed by way of description and not limitation.)

Figure 2:
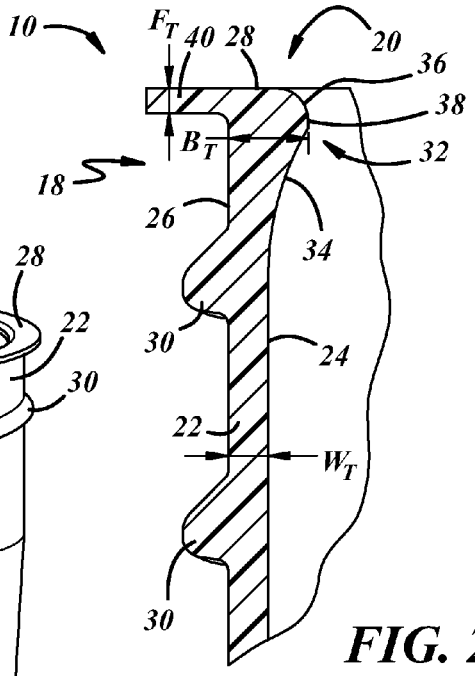
FIG. 2 is an enlarged fragmentary sectional view of a portion of the container of FIG. 1 taken from ellipse 2 of FIG. 1 and illustrating a container neck finish having a radially extending flange.

Referring now to FIG. 2, the neck finish 18 includes a finish wall 22 having an inner surface 24, an outer surface 26, and an end surface 28. Also, the neck finish 18 includes at least one seamless external thread segment 30 projecting from the outer surface 26 of the finish wall 28. As used herein, the term thread segment includes whole, partial, multiple, and/or an interrupted thread and/or thread segment.

The neck finish 18 further includes a bead 32 extending radially inwardly from the inner surface 24 and the end surface 28 of the finish wall 22. The bead 32 may be of any suitable geometry but, according to one example, the bead 32 may have an incurvate portion 34 extending from the inner surface 24 of the finish wall 22, an excurvate portion 36 extending from the end surface 28 of the finish wall 22, and a flat portion 38 extending between the incurvate and excurvate portions 34, 36. The flat portion 38 is at an angle of about 80 to about 88 degrees from a plane defined by the end surface 28 of the finish wall 22.

The bead 32 may enhance the container 10 one or more ways. For example, the bead 32 may rigidify the open end 20 of the container 10 to improve removal of the container 10 from its mold without damage to the container 10. In another example, the bead 32 may provide increased sealing area compared to prior containers and especially compared to prior RTF containers. The neck finish 18 includes a sealing surface radially extending at least from the end surface 28 of the finish wall 22 onto at least a portion of the bead 32. In other words, the sealing surface extends radially inwardly of the inner surface 24 of the finish wall 22 and over at least a portion of the bead 32 for increased axial sealing area.

The neck finish 18 additionally includes a flange 40, which is shown in FIG. 2 as extending radially outwardly from the outer surface 26 and the end surface 28 of the finish wall 22. The flange 40 may be used, for example, to provide a double-seamed end of the container 10 and/or to provide increased axial sealing area for a seal (not shown). As will be discussed in greater detail below, at least a portion of the flange 40 and the bead 32 may be simultaneously coined or formed by a coining operation. As a result of being formed by coining, the flange 40 has a compressed section thickness that is less than the as-molded thickness of the finish wall 22. Conversely, and also as a result of being formed by coining, the bead 32 has an enlarged section thickness relative to the as-molded thickness of the finish wall 22.

Figure 3:
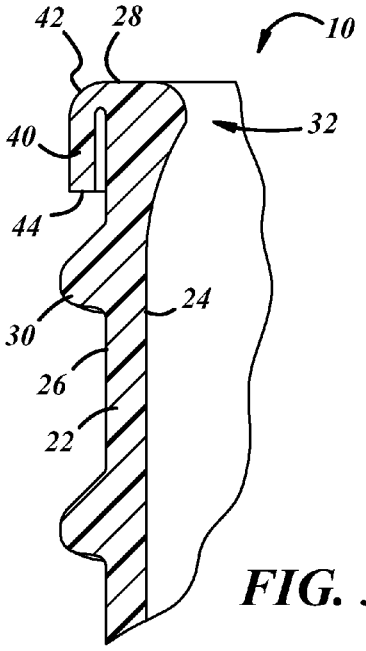
FIG. 3 is an enlarged fragmentary sectional view of the container portion of FIG. 2 and illustrating the flange bent downwardly in a generally axially extending direction.

As shown in FIG. 3, the flange 40 is bent to include a rounded shoulder portion 42 and to extend axially downwardly toward the at least one seamless external thread segment 30. The flange 40 may be bent according to any of a multitude of processes, for example, frictional spin-forming, thermoforming, or the like. For instance, during a trimming operation or after, a non-contact heat source may be used to selectively heat the radially extending flange 40 to a point at which the flange 40 is sufficiently softened for bending without breaking. Thereafter, a rotary or non-rotary cylindrical forming head may be brought into axial engagement with the softened, radially extending flange 40 to bend and cool the flange 40. Subsequently, the bent and cooled flange 40 retains its general axial orientation as shown in FIG. 3. Accordingly, the flange 40 is radially spaced from the finish wall 22 and terminates in a lower end 44 axially spaced from the at least one seamless external thread segment 30. The open end of the container 10 including a portion of the flange 40 may receive any suitable type of seal, for example, a peelable seal (not shown) or, as will be described in greater detail below, a frangible double-seamed type of seal (not shown). The thread segment 30 may have a major diameter greater in diameter than any other portion of the container 10.

The flange 40 may enhance the container in one or more ways. The flange 40 may provide increased sealing area compared to prior containers and especially compared to prior RTF containers. The sealing surface of the neck finish 18 may radially extend at least from the end surface 28 of the finish wall 22 onto at least a portion of the flange 40. In other words, the sealing surface extends radially outwardly of the outer surface 26 of the finish wall 22 and over at least a portion of the flange 40 for increased axial sealing area.

Preferably, the thickest section of any of the walls of the container 10 extends through the bead 32. As used herein the term "section" includes a wall section cut through a plane oriented perpendicular or normal to the length of the wall. For example, as shown in FIG. 2 a bead section $B_T$ is greater in section thickness than a wall section $W_T$ and a flange section $F_T$.

The container 10 preferably is produced by rotary thermoforming as will be discussed below, but instead may be produced by any other suitable method, for example, injection molding, parison or preform blow molding, compression molding, or the like. In other words, the container features disclosed herein may be applicable to other container manufacturing processes.

FIGS. 4 through 8 illustrate another exemplary embodiment of the present disclosure. This embodiment is similar in many respects to the embodiment of FIGS. 1 through 3 and like numerals between the embodiments designate like or corresponding elements throughout the several views of the drawing figures. Accordingly, much of the common subject matter will generally not be repeated here.

Figure 4:
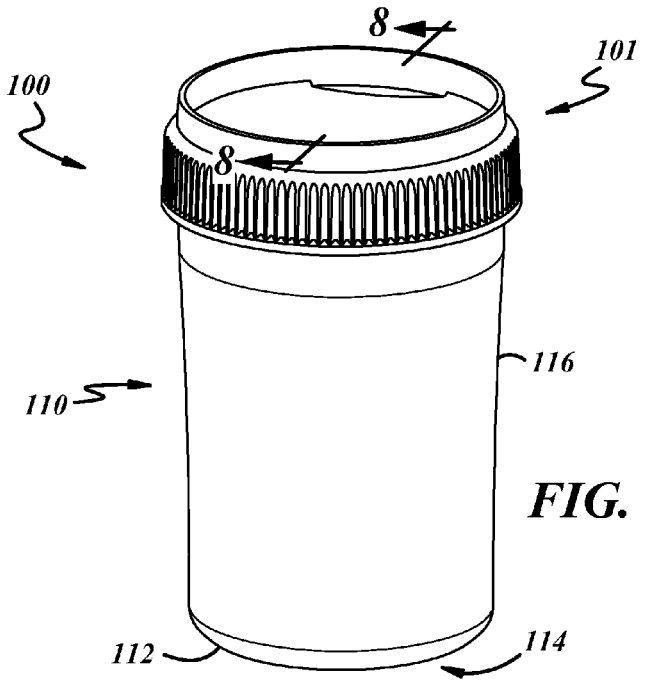
FIG. 4 is a perspective view of a package including a container in accordance with another exemplary embodiment of the present disclosure.

FIG. 4 illustrates an exemplary package 100 including a molded plastic container 110 and a closure 101 threaded to the container 110. The molded plastic container 110 includes a bottom wall 112 to define a closed end 114 of the container 110, and a side wall 116 extending generally axially away from the bottom wall 112.

Figure 5:
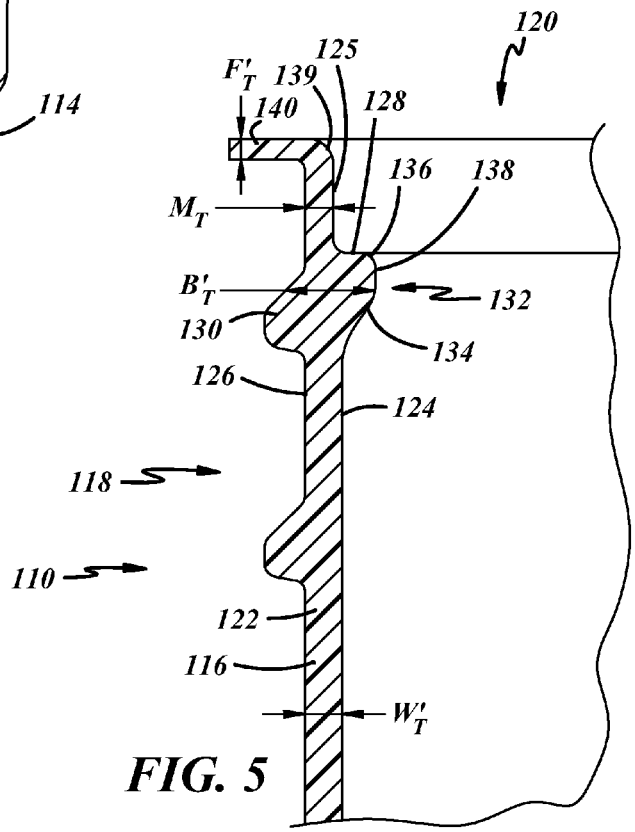
FIG. 5 is an enlarged fragmentary cross-sectional view of the container of FIG. 4, illustrating a thinned flange and a bead.

Referring now to FIG. 5, the container 110 also includes a neck finish 118 terminating the side wall 116 to define an open end 120 of the container 110. The neck finish 118 includes a finish wall 122 having an inner surface 124 and an outer surface 126. Also, the neck finish 118 includes at least one seamless external thread segment 130 projecting from the outer surface 126 of the finish wall 122.

The neck finish 118 further includes a bead 132 extending radially inwardly from the inner surface 124 of the finish wall 122. The bead 132 may have a first excurvate portion 134 extending from the inner surface 124 of the finish wall 122, a flat portion 138 extending from the first excurvate portion 134, a second excurvate portion 136 extending from the flat portion 138, and a shoulder portion 128 extending radially outwardly from the second excurvate portion 136. The flat portion 138 may be disposed generally parallel with a longitudinal axis L of the container 110, for example, within plus or minus about ten degrees.

The finish wall 122 extends upwardly beyond the thread segment 130 and the bead 132 wherein a second inner surface 125 of the finish wall 122 has an inner diameter greater than that of the inner surface 124. For example, the finish wall 122 may be thinner in cross section above the bead 132 than it is below the bead 132. The neck finish 118 additionally includes a flange 140 extending radially outwardly from the outer surface 126 of the finish wall 122. The neck finish 118 may include a rounded radially inner surface 139 at its open end 120. At least a portion of the flange 140, the second inner surface 125, and the bead 132 may be simultaneously formed by coining so that at least the flange 140 has a section thickness less than that of the portion of the finish wall 122 below the bead 132, and then the flange 140 may be bent and trimmed in any suitable manner. The thread segment 130 may have a major diameter greater in diameter than any other portion of the container 110.

Preferably, the thickest section of any of the walls of the container 110 extends through the bead 132. For example, as shown in FIG. 5 a bead section $B'_T$ is greater in section thickness than a wall section $W'_T$ and a flange section $F_T$ and a mouth section $M_T$.

Figure 6:
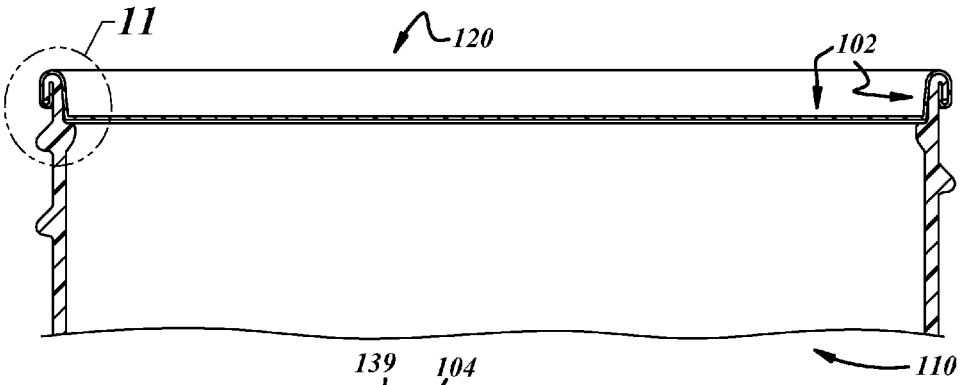
FIG. 6 is an enlarged fragmentary cross-sectional view of the container of FIG. 4, illustrating a seal rolled with the flange.
Figure 7:
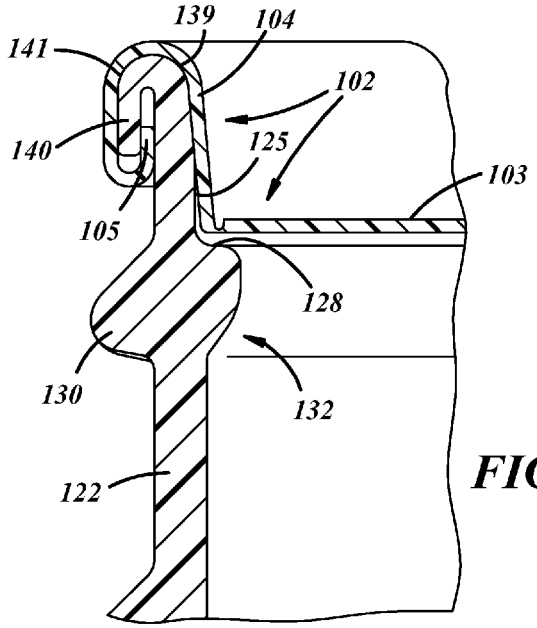
FIG. 7A is a further enlarged fragmentary cross-sectional view of the container illustrated in FIG. 6, illustrating another embodiment of the seal in relation to the container.

FIG. 6 illustrates a seal 102 applied to the container 110. The seal 102 may be any suitable seal, for example, a frangible pull-ring type of seal, which is a well known type of seal in the art. In one embodiment, the flange 140 first may be heated as previously described, and thereafter the seal 102 may be applied over the open end 120 of the container 110 as the container 110 is shown in FIG. 5, and then both the seal 102 and the flange 140 may be bent as shown in FIGS. 6 and 7 to define a double-seamed end. According to another embodiment, the seal 102 may be applied over the open end 120 of the container 110, and then both the seal 102 and the flange 140 may be heated and then bent to define the double-seamed end.

Figure 7A:
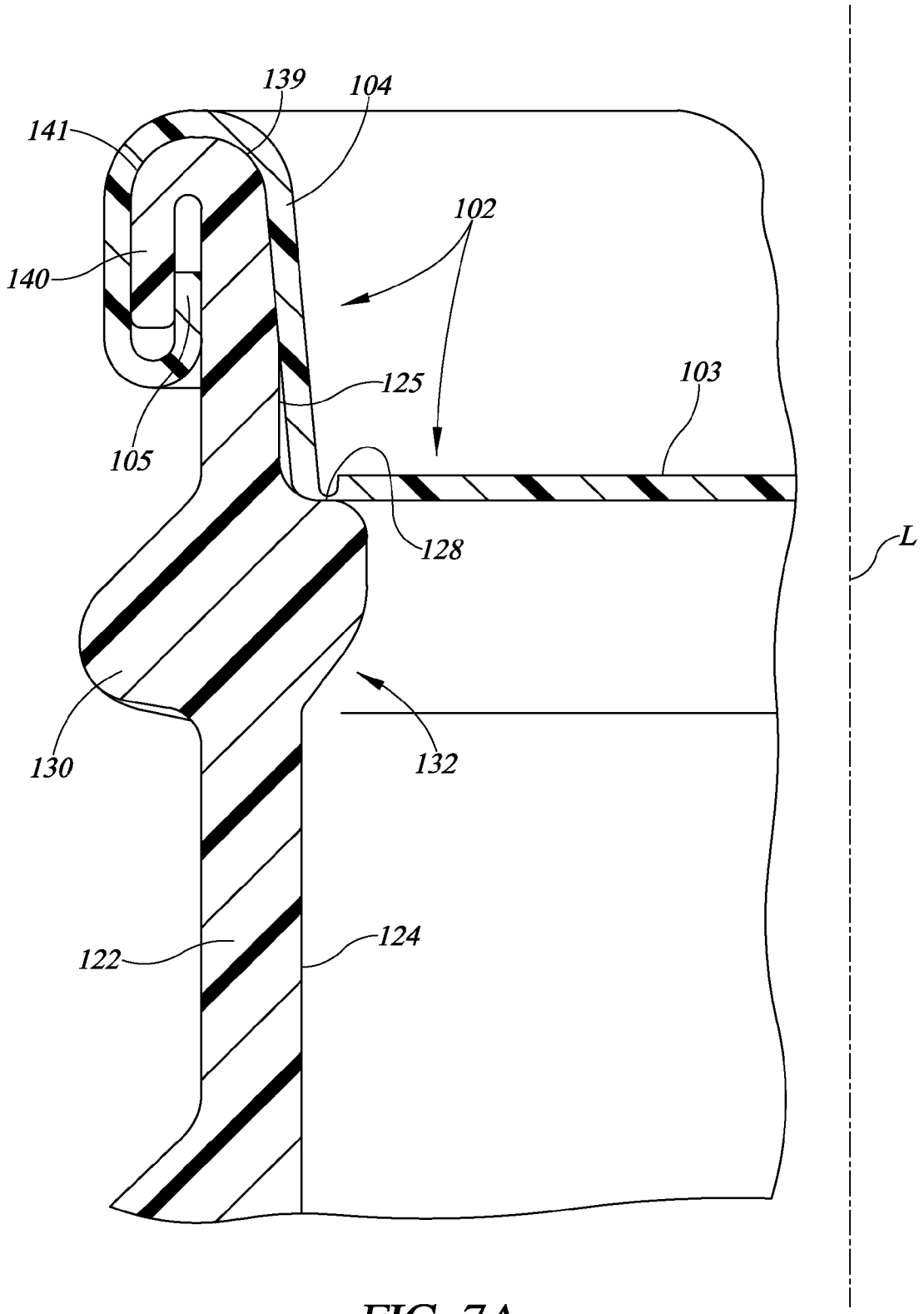

Referring to FIGS. 7 and 7A, the flange 140 includes a rounded radially outer surface 141 disposed radially outwardly of the rounded radially inner surface 139, and the flange 140 extends axially downwardly toward the at least one seamless external thread segment 130. The flange 140 is radially spaced from the finish wall 122 and terminates in a lower end 144 axially spaced from the at least one seamless external thread segment 130.

The seal 102 includes a transverse wall 103 having a lower surface that may be located against the shoulder portion 128 (FIG. 7A) or spaced just above it (FIG. 7) as shown. The seal 102 also includes a generally axially extending wall 104 extending from the transverse wall 103. The wall 104 may be outwardly conically shaped or tapered as shown. The rest of the seal 102 generally may follow the contour of the bent flange 140 as shown and includes a peripheral portion 105 that may be pinched between the outer surface of the finish wall 122 and a corresponding inner surface of the flange 140. In use, when a user removes the seal 102 from the container 110, the transverse wall 103 is separated from the wall 104 by a frangible portion therebetween as is known. The transverse wall 103 may be discarded but the wall 104 remains and may terminate in a rough lower end.

The bead 132 may enhance the container 110 in one or more ways. In a first example, the bead 132 may radially overlap the lower end of the wall 104 as shown to prevent a user's finger from contacting the rough lower end of the wall 104 after the transverse wall 103 is separated. In another example, the bead 132 may rigidify the open end 120 of the container 110 and, thus, may improve removal of the container 110 from its mold without damage to the container 110.

Figure 8:
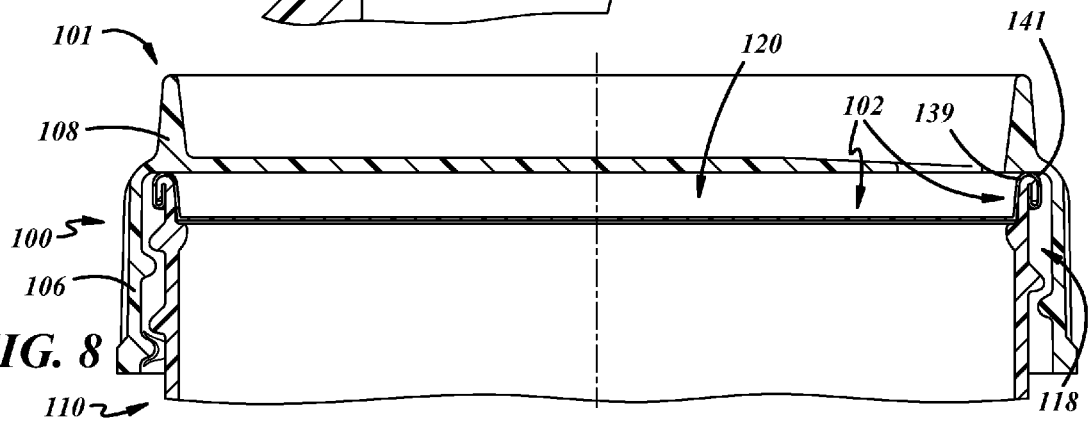
FIG. 8 is an enlarged fragmentary cross-sectional of the package of FIG. 4, illustrating the container, its seal, and a closure coupled to the container and engaged with the seal.

Referring now to FIG. 8, the closure 101 includes a threaded skirt 106 for threaded coupling to the neck finish 118 of the container 110, and a base wall 108 from which the skirt 106 generally axially depends.

FIGS. 9 through 12 illustrate another aspect of the present disclosure in the form of various exemplary thermoforming equipment to produce the containers of FIGS. 1 through 8. In general, thermoforming includes the forming of plastic sheets into articles by application of heat and pressure and includes discrete thermoforming, transfer press thermoforming, rotary thermoforming, and the like. More specifically, vacuum rotary thermoforming involves moving a warm thermoplastic sheet into contact with a surface of a rotary mold wheel and pulling vacuum from within a mold cavity of the mold wheel to pull the sheet down into conformity with the surfaces of the mold cavity.

Figure 9:
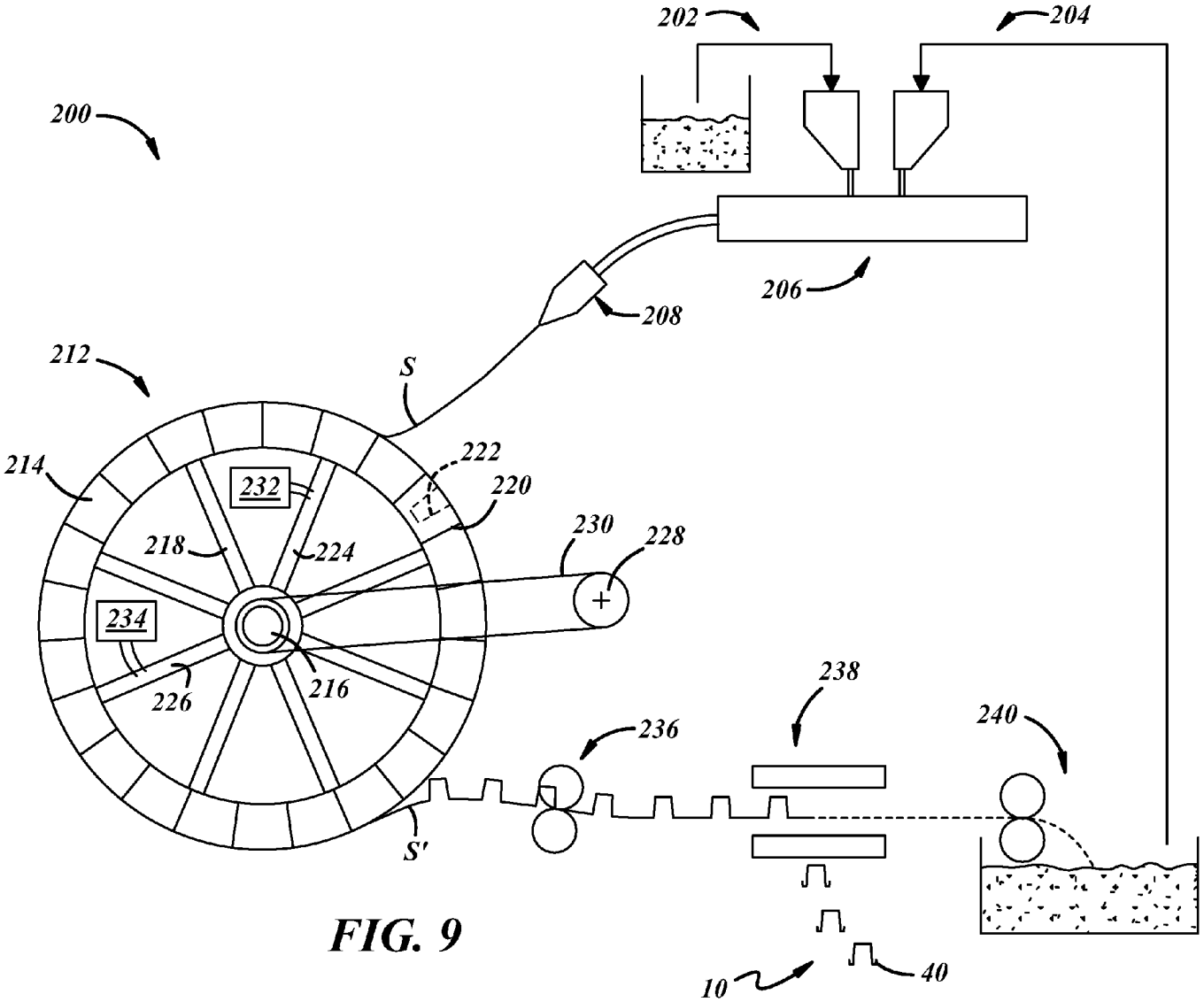
FIG. 9 is a schematic view of a rotary thermoforming (RTF) system in accordance with another exemplary embodiment of the present disclosure and that may be used to produce the container of FIG. 1.

FIG. 9 illustrates a schematic of one particular example of a vacuum rotary thermoforming system 200. The system 200 includes a source of virgin thermoplastic material 202 and may also include a source of reclaimed thermoplastic material 204. These materials 202, 204 are blended in and processed by an extruder 206 including an extrusion die 208 out of which a thermoplastic sheet S is fed. The extruder 206 may produce the sheet S as a single layer or the extruder 206 may be a co-extrusion apparatus to produce the sheet S with multiple layers, which may include structural, barrier, and/or adhesive layers.

The system 200 also includes a rotary thermoforming wheel 212 to which the sheet S is applied for forming articles as the wheel 212 rotates counterclockwise. The wheel 212 includes a rim 214, a hub 216, and one or more spoke members 218 between the rim 214 and the hub 216. The rim 214 includes a plurality of molds 220 defining an exterior surface of the wheel 212 and defining mold cavities 222 into which portions of the sheet S are formed to produce containers. The wheel 212 also includes various pneumatic conduit 224 and coolant conduit 226 which may include separate hoses, tubes or pipes or the like, or integral passages in the rim 214, hub 216, and/or spoke members 218. Those of ordinary skill in the art will recognize that the wheel 212 also includes various other devices and components, for example, seals, bearings, bushings, and the like as well as frames, bases, and other structural members.

The system 200 also includes a prime mover 228 to rotate the wheel 212, and a coupling member 230 between the prime mover 228 and the hub 216. The prime mover 228 may be an electric, hydraulic, or pneumatic motor or any other suitable device to rotate the wheel 212. The coupling member 230 may be a belt, chain, geartrain, or any other suitable device to communicate motion from the prime mover 228 to the wheel 212.

The system 200 may further include a source of coolant 232 that may be communicated to the coolant conduit 226 of the wheel 212, for example, by coolant lines and rotatable coolant couplings, or in any other suitable manner. The coolant 232 is used to cool one or more of the molds 220 in any suitable manner.

The system 200 additionally includes a vacuum source 234 that may be communicated to the pneumatic conduit 224 of the wheel 212, for example, by pneumatic lines and rotatable pneumatic couplings, or in any other suitable manner. The vacuum source 234 is used to evacuate or "pull vacuum" in the molds 220 in any suitable manner. Although not shown here, the molds 220 include a plurality of vacuum ports in communication with the pneumatic conduit 224 and variously located in the molds 220 to pull the sheet S into conformity with surfaces of the molds 220 in the mold cavities 222.

The system 200 also includes rollers 236 to assist in removing a formed sheet S' off of the wheel 212 and conveying the formed sheet S' to a downstream bending and trimming station 238 to remove finished containers 10 from the formed sheet S'. Moreover, a grinding station 240 downstream of the bending and trimming station 238 grinds the trimmed sheet S" into reclaimed thermoplastic material which may be fed to the source of reclaimed thermoplastic material 204.

The system 200 includes any other well known devices, for example, pneumatic and hydraulic valves, sensors, material handling devices, controllers, and/or the like. Because rotary thermoforming systems are well known to those of ordinary skill in the art, detailed discussion of such portions are not necessary for one of ordinary skill in the art to understand the inventions disclosed herein and, thus, are omitted for conciseness.

Figure 10:
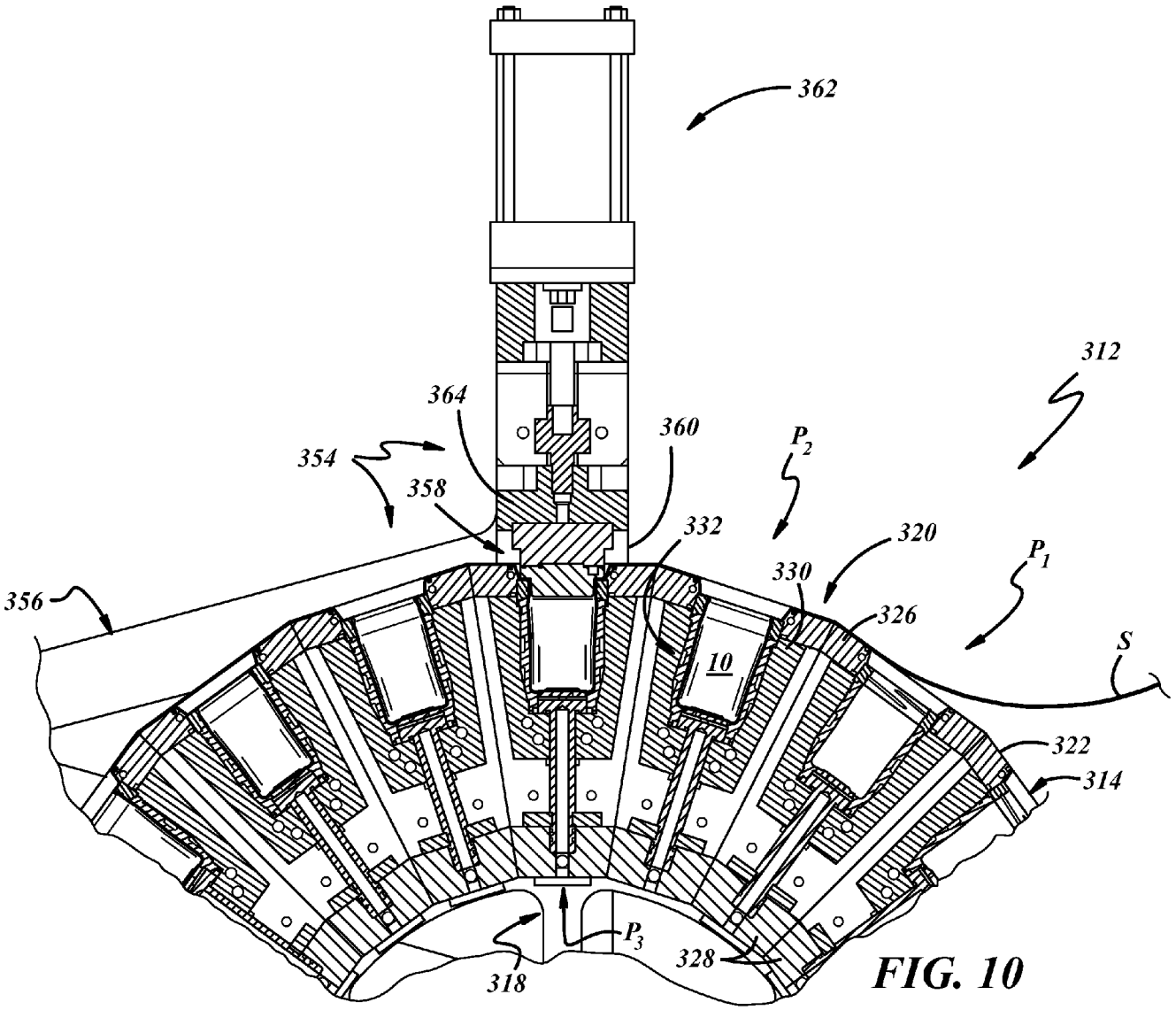
FIG. 10 is a fragmentary cross-sectional view of an exemplary RTF wheel illustrating a forming and coining operation.

FIG. 10 illustrates an exemplary rotary thermoforming apparatus including an exemplary rotary thermoforming wheel 312, which may be used in the system 200 of FIG. 9. The wheel 312 includes a rim 314, a hub (not shown), and one or more spoke member(s) 318 between the rim 314 and the hub 316. The wheel 312 includes a plurality of molds 320 at its rim 314 defining an exterior surface 322 of the wheel 312 and a plurality of mold cavities 324 to form a container. The molds 320 include fixed facet plates 326 at the rim 314 that collectively define the exterior surface 322, and fixed inner segments 328 that are coupled to the spoke member(s) 318 and to the facet plates 326 by side plates (not shown). The molds 320 also include movable mold housings 330 carried radially inwardly of the facet plates 326 and radially outwardly of the inner segments 328. As used herein, the term "coupled" includes use of separate or integral fasteners, welding, adhesion, use of pins, or any other type of coupling in any suitable manner. The molds 320 further include mold inserts 332 carried in the mold housings 330 and defining a body portion and at least a portion of a neck finish of the container 10.

Figure 11:
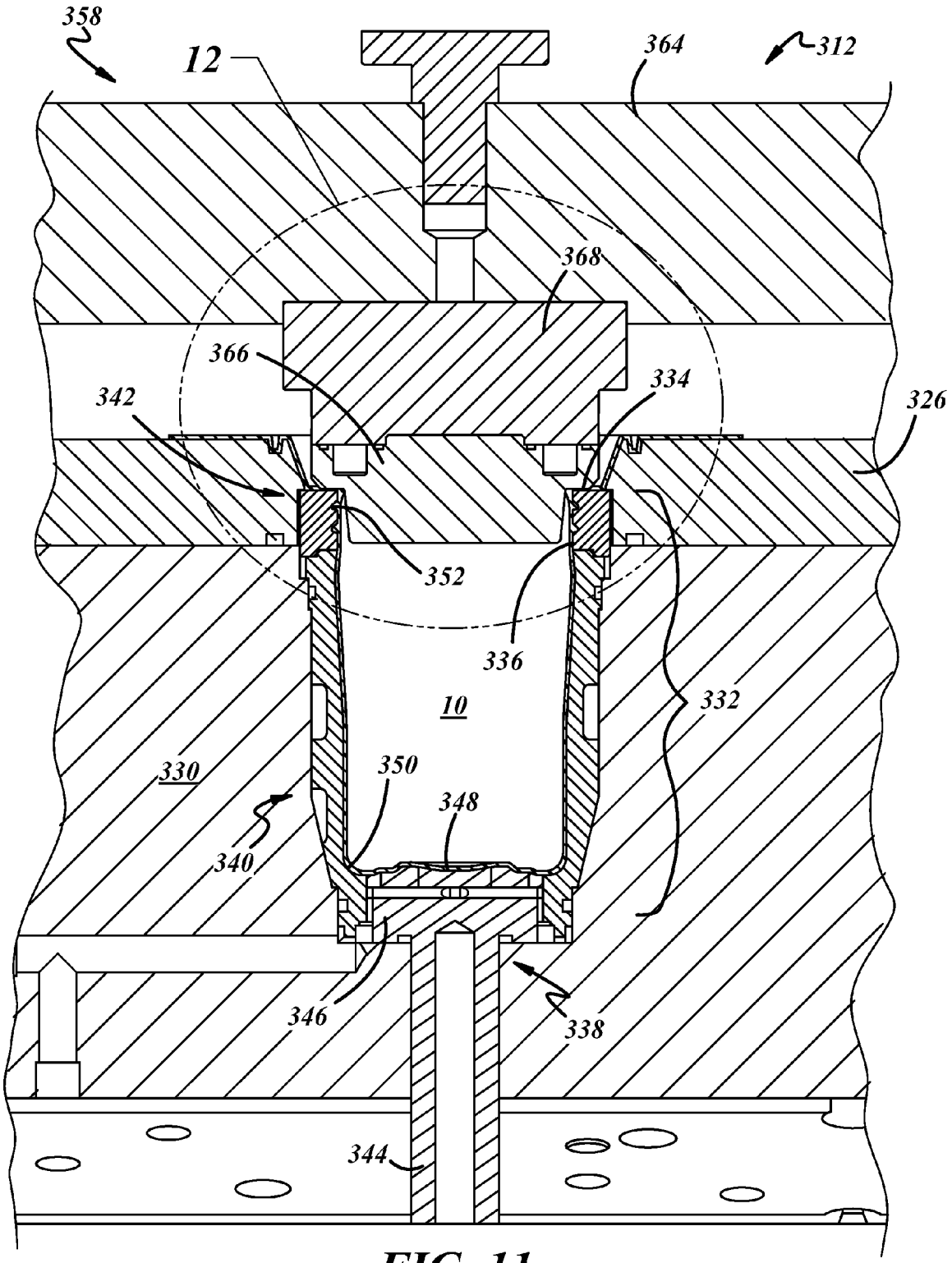
FIG. 11 is an enlarged, fragmentary, sectional view of a mold portion of the RTF wheel of FIG. 10.

Referring to FIG. 11, the mold inserts 332 include an axial end surface 334 and an inner surface 336 (FIG. 6). The mold insert 332 may include one or more portions, for example, a bottom portion 338 generally corresponding to a bottom wall of the container 10, a body portion 340 generally corresponding to side walls of the container 10, and a neck finish portion 342 generally corresponding to a neck finish portion of the container 10. The bottom portion 340 includes a stem portion 344 and a disk portion 346 extending from the stem portion 344 and having a mold cavity surface 348 to at least partially define a bottom wall of the container 10. The mold cavity surface 348 may be stepped to provide a flexible bottom wall of the container 10. The body portion 340 may include a chime surface 350 to define a rounded chime of the container 10 between a bottom wall and a side wall of the container. The neck finish portion 342 is provided with at least one thread segment recess 352 to define at least one thread segment of a neck finish of the container.

Referring again to FIG. 10, a portion of the thermoplastic sheet S is fed onto the wheel 312 at one of the molds 320 at a first mold position P1. Vacuum is pulled through apertures in the facet plates 326 of the molds 320 to pull the sheet S into tight contact with the exterior surface 322 of the wheel 312. At an adjacent, second, mold position P2, a portion of the sheet S is formed into one of the molds 320, for example, by evacuating the mold cavity 324 thereof to pull the portion of the sheet S into conformity with interior surfaces of the mold insert 332. At this second position, a molding assist tool (not shown) may also be used. For example, although not shown, a male mold tool may be positioned radially outwardly of the wheel 312 for reciprocation into the mold cavity 324 to force the portion of the sheet S into conformity with the surfaces of the mold insert 332 and/or to define inside surfaces of the container 10 formed from the sheet S.

Referring still to FIG. 10, the wheel 312 also includes a coining apparatus 354 generally disposed radially outward of the molds 320 at a third mold position P3, for example, at a 12 o'clock position as shown. In one exemplary embodiment, the coining apparatus 354 includes a frame 356 that may be supported on either side of the wheel 312 in any suitable manner.

The coining apparatus 354 also includes exemplary coining tooling 358 that may be slidably coupled to a cross member 360 of the frame 356 in any other suitable manner. The coining tooling 358 is advanced and retracted, for example, by an actuator 362, which may include, for example, a hydraulic, pneumatic, or electric actuator, supplied with liquid, gas, or electricity and being controlled in any suitable manner known to those of ordinary skill in the art.

Figure 12:
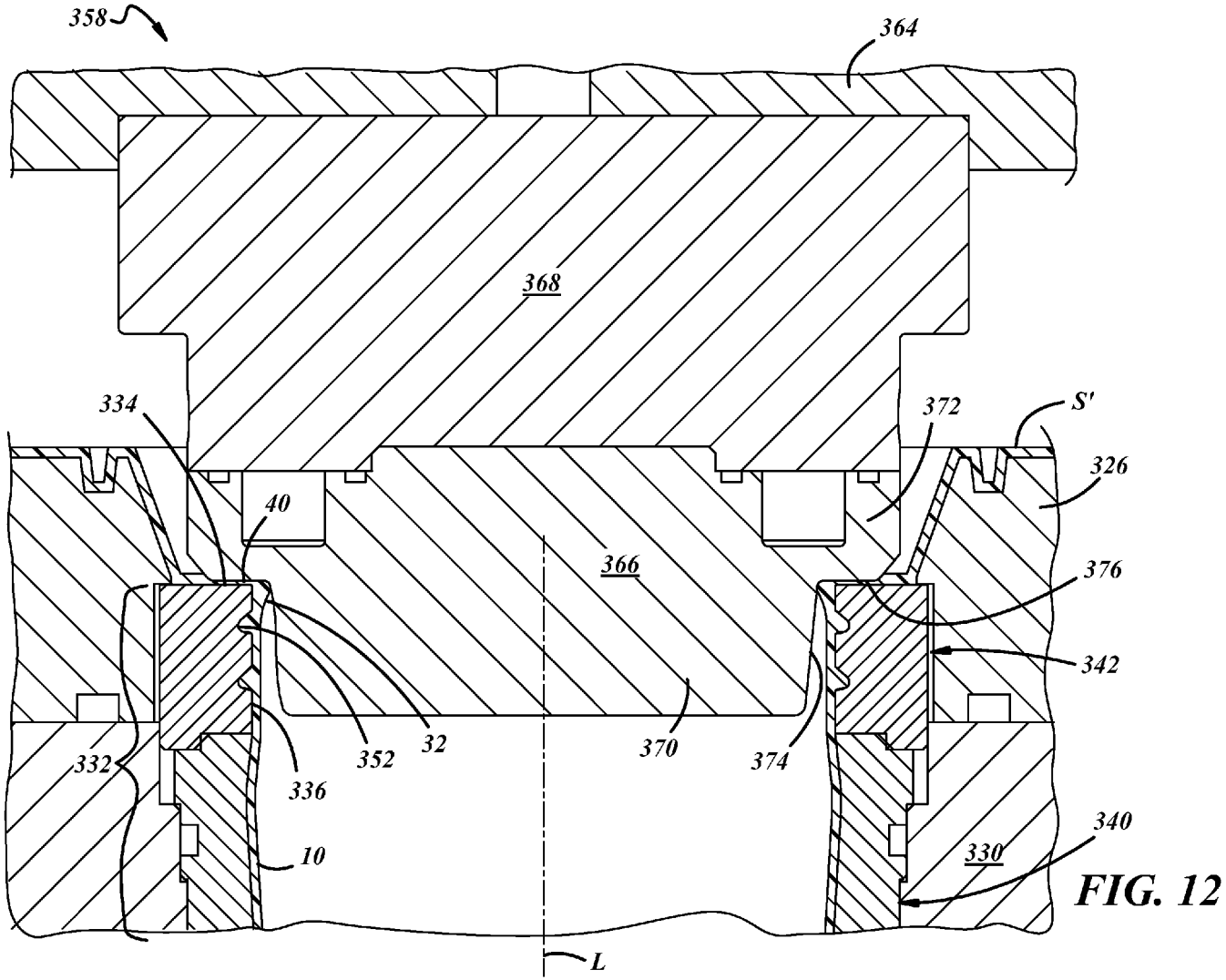
FIG. 12 is an enlarged, fragmentary, sectional view of coining tooling of the mold portion of the RTF wheel of FIG. 10 taken from ellipse 12 of FIG. 11.
Figure 6:
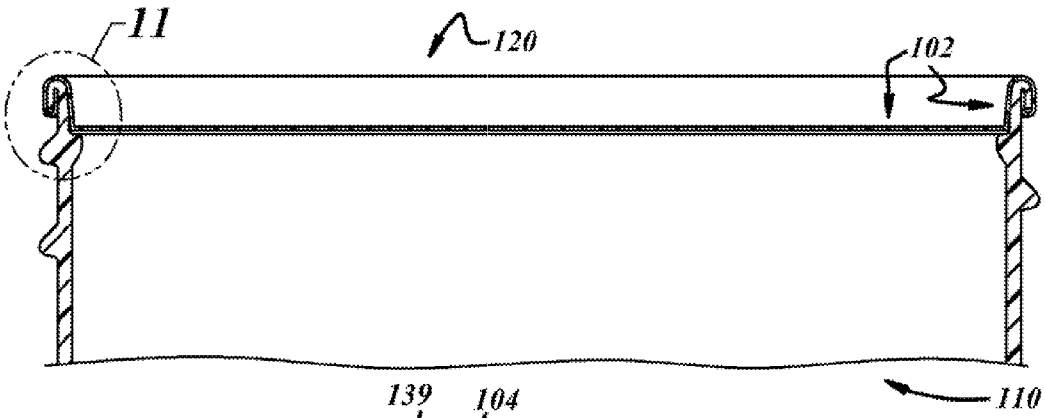
Figure 7:
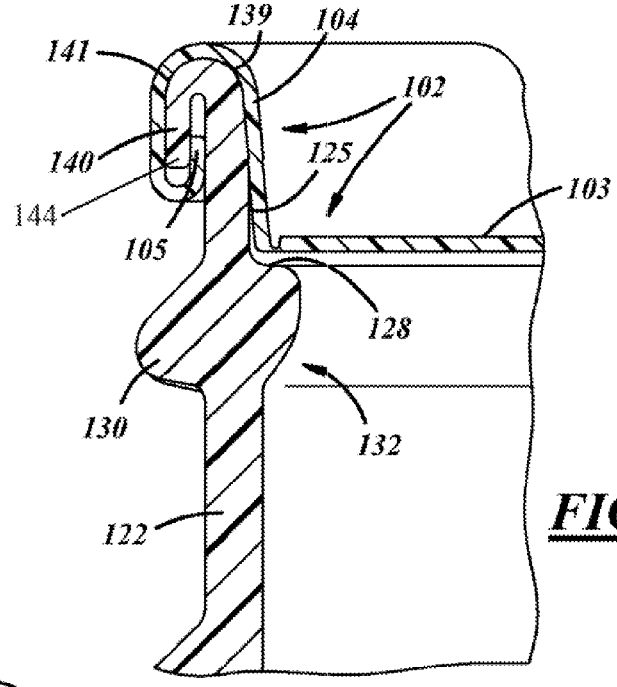
Figure 8:
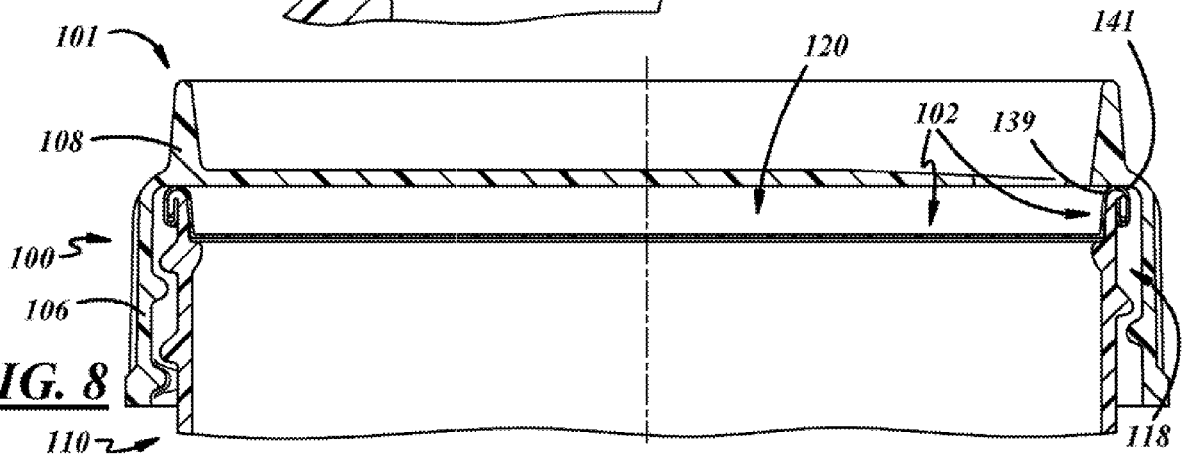
Figure 7A:
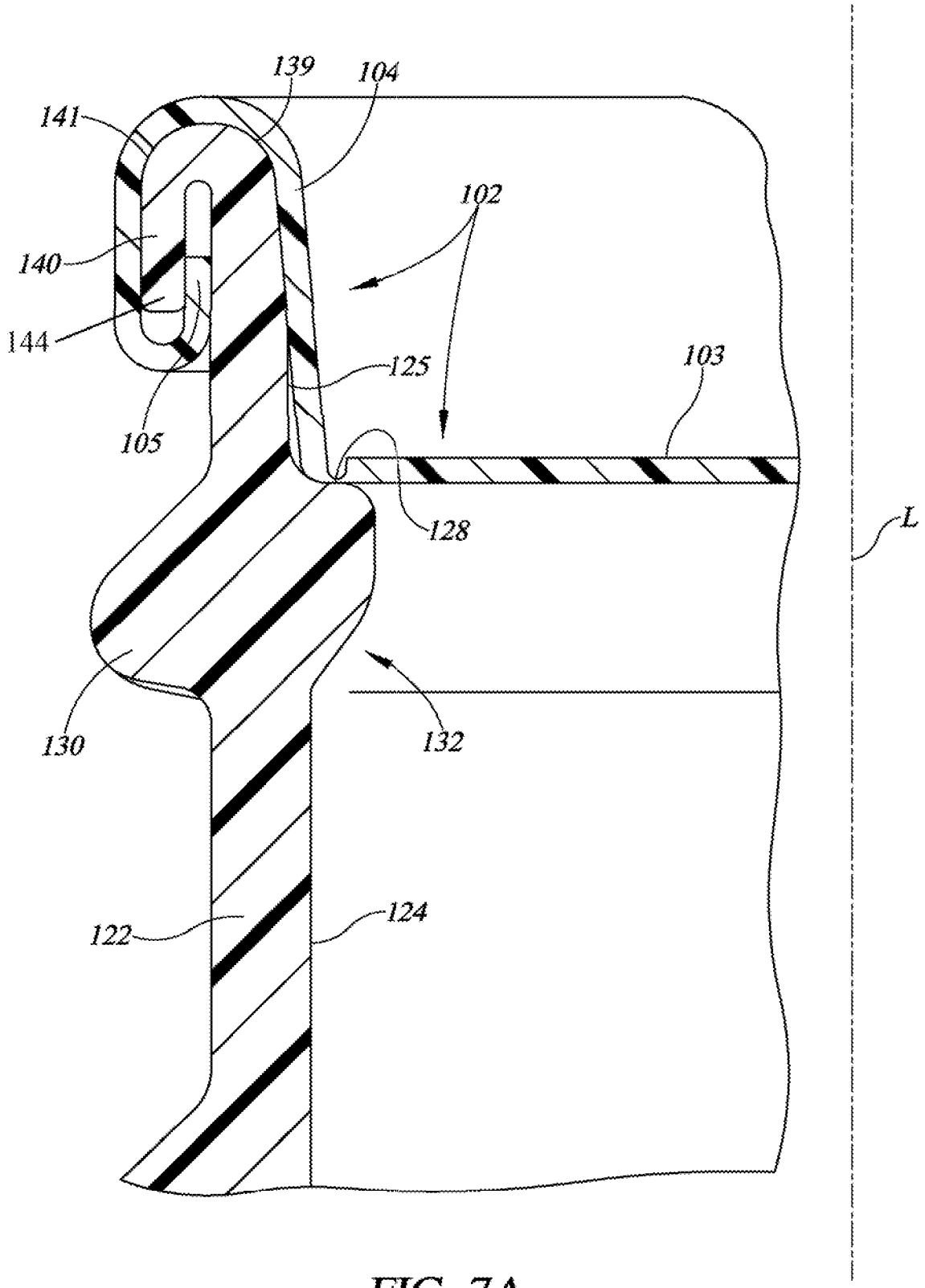
Figure 10:
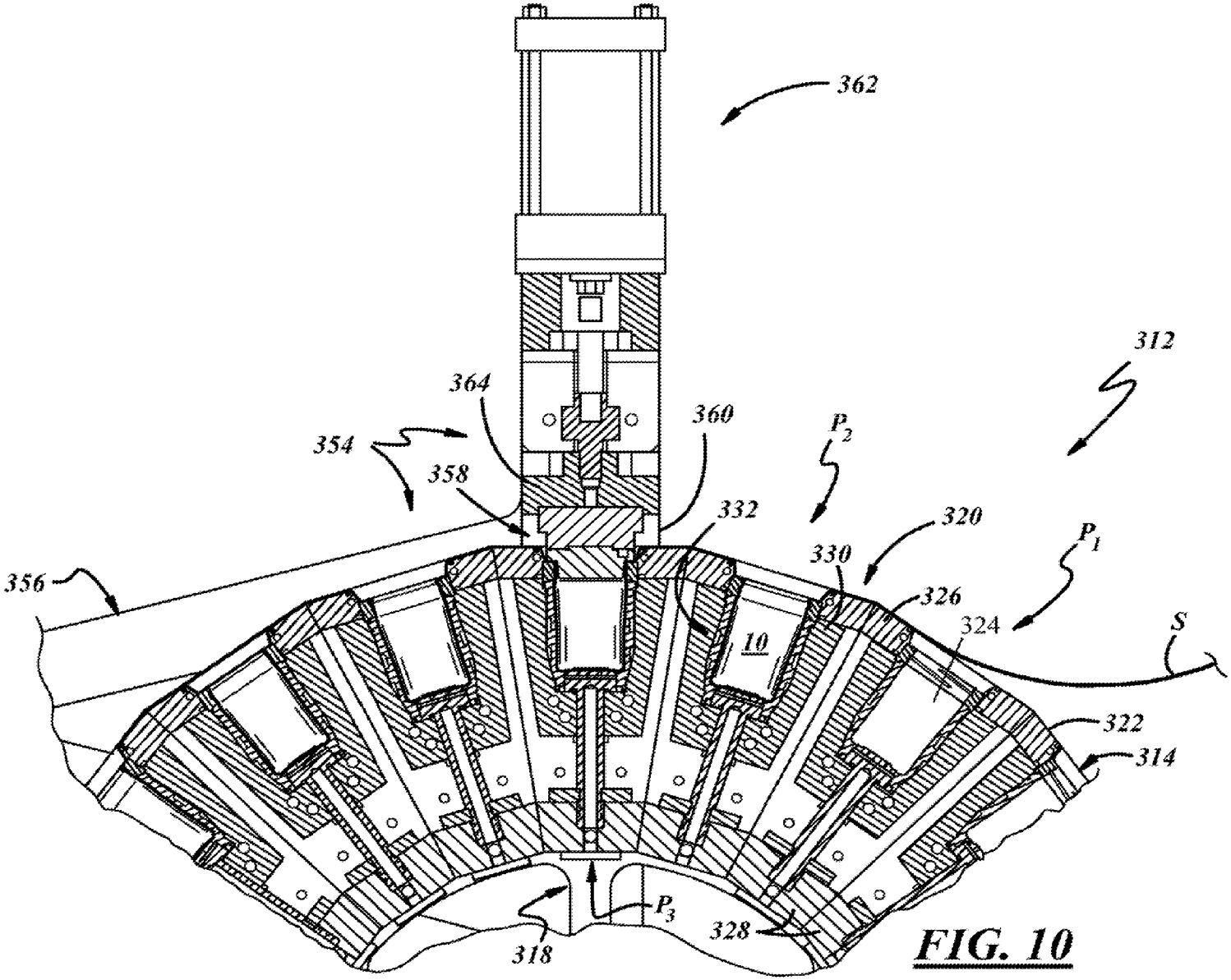

As shown in FIG. 12, the example coining tooling 358 includes a main body 364 that is coupled to the actuator of FIG. 10, for example, and may be located to the facet plate 326 with any suitable locator pins or the like (not shown). The example coining tooling 358 further includes a coining die 366 and a die support 368 to couple the die 366 to the main body 364. The coining die 366 includes a body portion 370 for insertion into the mold insert 332 and a shoulder portion 372 extending radially outwardly of the body portion 370 for cooperation with the axial end surface 334 of the mold insert 332.

The coining apparatus 358 coins a portion of the formed sheet S' between the coining die 366 and at least portions of the axial end surface 334 and inner surface 336 of the mold insert 332 to define the container bead 32, and to define a sealing surface radially extending onto at least a portion of the bead 32. Accordingly, the geometry of the shoulder 372 and body 370 of the coining die 366 are designed to produce particular geometry desired for at least a portion of a neck finish of the container 10. The body portion 370 may include a tapered or conical outer surface 374 and the shoulder portion 372 may include a relatively flat surface 376 that may be approximately perpendicular to a longitudinal axis L of the container 10. The coining die 366 compresses a radially extending portion of the formed sheet S' to define the relatively thin flange 40, which is thinner than the general wall thickness of the container 10, and simultaneously allows material to flow into a radial space between the mold insert 332 and the body portion 370 of the coining die 366 to define the relatively thicker bead 32, which is thicker than the general wall thickness of the container 10.

The wheel 312 may include one or more cooling mold positions downstream of the vacuum forming and coining positions P2, P3. Mold cooling of an RTF apparatus is well known to those of ordinary skill in the art and need not be discussed in detail herein. Those of ordinary skill in the art will recognize that any suitable number of molds and mold positions may be used depending on the particular application.

As the wheel 312 rotates, the mold housing 330 retracts or moves radially inwardly relative to other portions of the mold 320 including the fixed bottom portion 346 of the mold insert 332 whose stem 344 is coupled to the fixed inner plate 328 of the mold 320. The thread segment 30 of the container 10 becomes dislodged from its corresponding mold insert 332 without damage to the container 10 and without a seam on the thread segment 30. A lock nut 331 may be used to precisely set the radial location of the mold insert bottom portion 346. The mold housings 330 may be retracted in any suitable manner. Such apparatuses to impart relative movement between mold sections are well known and classified in the art. After the mold 32 and mold housing 330 is fully retracted, the formed sheet S' with the formed containers 10 still attached, may be pulled away from the wheel 312 in any suitable manner and conveyed downstream to any other suitable processing operations. For example, referring to FIG. 9, the formed sheet S' may be processed at the bending and trimming station 338 to bend the container flanges 40 and trim the containers 10 away from the sheet S'.

There thus has been disclosed a container that satisfies at least one of the objects and aims previously set forth. The disclosure has been presented in conjunction with several exemplary embodiments, and additional modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A molded plastic container, comprising:

a bottom wall to define a closed end of said container;

a side wall extending generally axially along a longitudinal axis of said container away from said bottom wall; and a neck finish terminating said side wall to define an open end of said container and including:

a finish wall having an inner surface, an outer surface, and an end surface, and at least one external thread segment projecting from said outer surface of said finish wall, a bead extending radially inwardly from said inner surface of said finish wall, and a flange extending radially outwardly from said finish wall and also extending axially downwardly along said longitudinal axis of said container toward said at least one external thread segment;

a seal applied to at least a portion of said flange, wherein said seal is a frangible seal having a generally axially extending wall and a removable transverse wall frangibly coupled to a lower end of said axially extending wall, wherein said removable transverse wall is separated from said lower end of said axially extending wall to provide access through said open end of said container when said axially extending wall remains attached to said portion of said flange, wherein said axially extending wall extends along said longitudinal axis of said container and is in contact with said inner surface of said finish wall and said lower end of said axially extending wall is located against or spaced just above said bead of said container neck finish wall; and wherein said bead extending radially inwardly from said inner surface of said finish wall radially overlaps said lower end of said axially extending wall when said axially extending wall remains attached to said portion of said flange.

2. The molded plastic container of claim 1, wherein said lower end of said axially extending wall is located against said bead.

3. The molded plastic container of claim 1, wherein said lower end of said axially extending wall is spaced just above said bead.

4. The molded plastic container of claim 1, wherein said inner surface includes a first inner surface below said bead and a second inner surface above said bead, wherein said axially extending wall is in contact with said second inner surface.

5. The molded plastic container of claim 1, wherein said seal is applied to said end surface, said inner surface, and said portion of said flange.

* * * * *

UNITED STATES PATENT AND TRADEMARK OFFICE

CERTIFICATE OF CORRECTION

PATENT NO. : 9,493,266 B1
APPLICATION NO. : 12/392515
DATED : November 15, 2016
INVENTOR(S) : Darrin R. Jankowski et al.

It is certified that error appears in the above-identified patent and that said Letters Patent is hereby corrected as shown below:

On the Title Page

Delete the title page and substitute therefore with the attached title page consisting of the corrected illustrative figure Column 2, Line 5, item (57), Abstract: delete "an" after "finish wall having"

In the Drawings

Please replace FIGS. 6, 7, 8, 7A, and 10 with FIGS. 6, 7, 8, 7A, and 10 as shown on the attached pages In the Specification Column 1, Line 10: replace "an RTF" with --a RTF--
Column 3, Line 13: replace "finish wall 28" with --finish wall 22--
Column 3, Line 27: insert --in-- after "container 10"
Column 3, Line 37: replace "inwardly of" with --inwardly from--
Column 4, Line 17: replace "outwardly of" with --outwardly from--
Column 6, Line 48: replace "geartrain" with --gear train--
Column 7, Line 10: replace "well known" with "well-known"
Column 7, Line 23: delete "316" after "hub"
Column 7, Line 40: delete "(FIG. 6)" after "336"
Column 8, Line 24: replace "located to" with --located on--
Column 8, Line 30: replace "outwardly of" with --outwardly from--
Column 9, Line 12: replace "338" with --238--

Signed and Sealed this
Twentieth Day of June, 2017

Joseph Matal

Joseph Matal
*Performing the Functions and Duties of the*
*Under Secretary of Commerce for Intellectual Property and*
*Director of the United States Patent and Trademark Office*

(12) United States Patent
Jankowski et al.

(10) Patent No.: US 9,493,266 B1
(45) Date of Patent: Nov. 15, 2016

(54) MOLDED PLASTIC CONTAINER

(75) Inventors: Darrin Ross Jankowski, Union, MO (US); Edward J. Huels, Jr., Union, MO (US); Joshua J. Haen, Maple Grove, MN (US); David J. Lewis, Ramsbury (GB)

(73) Assignee: Silgan Plastic Food Containers Corporation, Union, MO (US)

( * ) Notice: Subject to any disclaimer, the term of this patent is extended or adjusted under 35 U.S.C. 154(b) by 1144 days.

(21) Appl. No.: 12/392,515

(22) Filed: Feb. 25, 2009

(51) Int. Cl.

| | |
|---|---|
| ***B65D 1/02*** | (2006.01) |
| ***B65D 1/16*** | (2006.01) |
| ***B65D 1/46*** | (2006.01) |
| ***B65D 51/20*** | (2006.01) |
| ***B65D 17/00*** | (2006.01) |
| ***B65D 53/00*** | (2006.01) |
| ***B65D 51/18*** | (2006.01) |
| ***B65D 6/00*** | (2006.01) |
| ***B65D 8/04*** | (2006.01) |
| ***B65D 8/18*** | (2006.01) |
| ***B65D 90/02*** | (2006.01) |

(52) U.S. Cl.
CPC ..... *B65D 1/02* (2013.01); *B65D 51/20* (2013.01)

(58) Field of Classification Search
CPC ..... B65D 1/02; B65D 1/16; B65D 1/46; B65D 51/20; B65D 17/161
USPC ..... 215/349, 350; 220/254.8, 258.1, 258.3, 220/258.5, 675
See application file for complete search history.

(56) References Cited

U.S. PATENT DOCUMENTS

| | | | | |
|---|---|---|---|---|
| 3,412,889 | A * | 11/1968 | Eicholtz et al. | 220/788 |
| 4,244,915 | A | 1/1981 | Boardman | |
| 4,346,833 | A * | 8/1982 | Bernhardt | 220/257.1 |
| 4,420,300 | A | 12/1983 | Winstead | |
| 4,817,807 | A * | 4/1989 | Hummer | 215/253 |
| 4,942,974 | A * | 7/1990 | Larrison | B65D 43/021 220/214 |
| 5,459,960 | A | 10/1995 | Manlove | |
| 5,783,229 | A | 7/1998 | Manlove | |

(Continued)

FOREIGN PATENT DOCUMENTS

WO WO 02/085713 10/2002

OTHER PUBLICATIONS

European Patent Office; International Search Report and Written Opinion of the International Searching Authority; Search Report and Written Opinion for PCT/US2010/023909; Aug. 31, 2010; European Patent Office; the Netherlands.

*Primary Examiner* — Fenn Mathew
*Assistant Examiner* — Andrew T Kirsch
(74) *Attorney, Agent, or Firm* — Middleton Reutlinger; John F. Salazar; Chad D. Bruggeman

(57) ABSTRACT

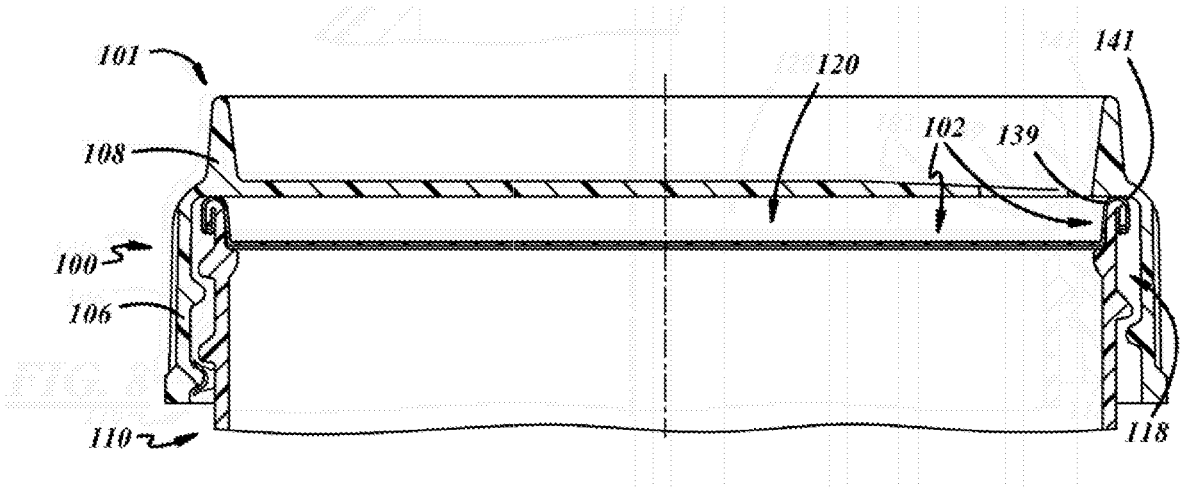

A molded plastic container includes a bottom wall to define a closed end of the container, a side wall extending generally axially away from the bottom wall, and a neck finish terminating the side wall to define an open end of the container. The neck finish includes a finish wall having an inner and outer surfaces. Also, the neck finish may include a seamless external thread segment projecting from the outer surface of the finish wall, and/or a flange extending radially outwardly from the finish wall and also extending axially downwardly and having a section thickness less than that of the finish wall, and/or a bead extending radially inwardly from the inner surface of the finish wall wherein the thickest (Continued)